US005141117A

United States Patent [19]

Olsen et al.

[11] Patent Number: 5,141,117

[45] Date of Patent: Aug. 25, 1992

[54] TUBE DISPLAY DEVICE

[76] Inventors: Leanora B. Olsen, 111 N. Wilmette St., Westmont, Ill. 60559; Suzanne M. Wodka, 539 Selbourne Rd., Riverside, Ill. 60546

[21] Appl. No.: 786,171

[22] Filed: Oct. 31, 1991

[51] Int. Cl.[5] ..... A47F 7/00

[52] U.S. Cl. ..... 211/71; 211/60.1; 211/74; 211/194

[58] Field of Search ..... 211/71, 60.1, 74, 194, 211/188, 150, 186

[56] References Cited

U.S. PATENT DOCUMENTS

| | | | |
|---|---|---|---|
| 2,681,262 | 6/1954 | Vincent | 211/60.1 X |
| 2,749,004 | 6/1956 | Hilts et al. | 211/74 X |
| 4,074,810 | 2/1978 | Juergens et al. | 211/126 X |
| 4,124,122 | 11/1978 | Emmitt | 211/74 |
| 4,138,015 | 2/1979 | Rabley | 211/126 X |
| 4,588,095 | 5/1986 | Meha | 211/74 |
| 4,911,311 | 3/1990 | Nagai | 211/188 X |
| 5,011,028 | 4/1991 | Sweeney | 211/60.1 |

*Primary Examiner*—Robert W. Gibson, Jr.
*Attorney, Agent, or Firm*—Richard C. Litman

[57] ABSTRACT

A storage rack for squeeze tubes is provided with a plurality of openings to allow the tubes to rest there within. An upright structure includes a panel which pivots and a removable panel which sets below the pivotable panel. The pivotable panel forms a slope which permits access to all storage openings. The storage racks are configured to be stackable with a tab and tab receiving slots on the top and bottom surface of the right and left side vertical supports.

9 Claims, 2 Drawing Sheets

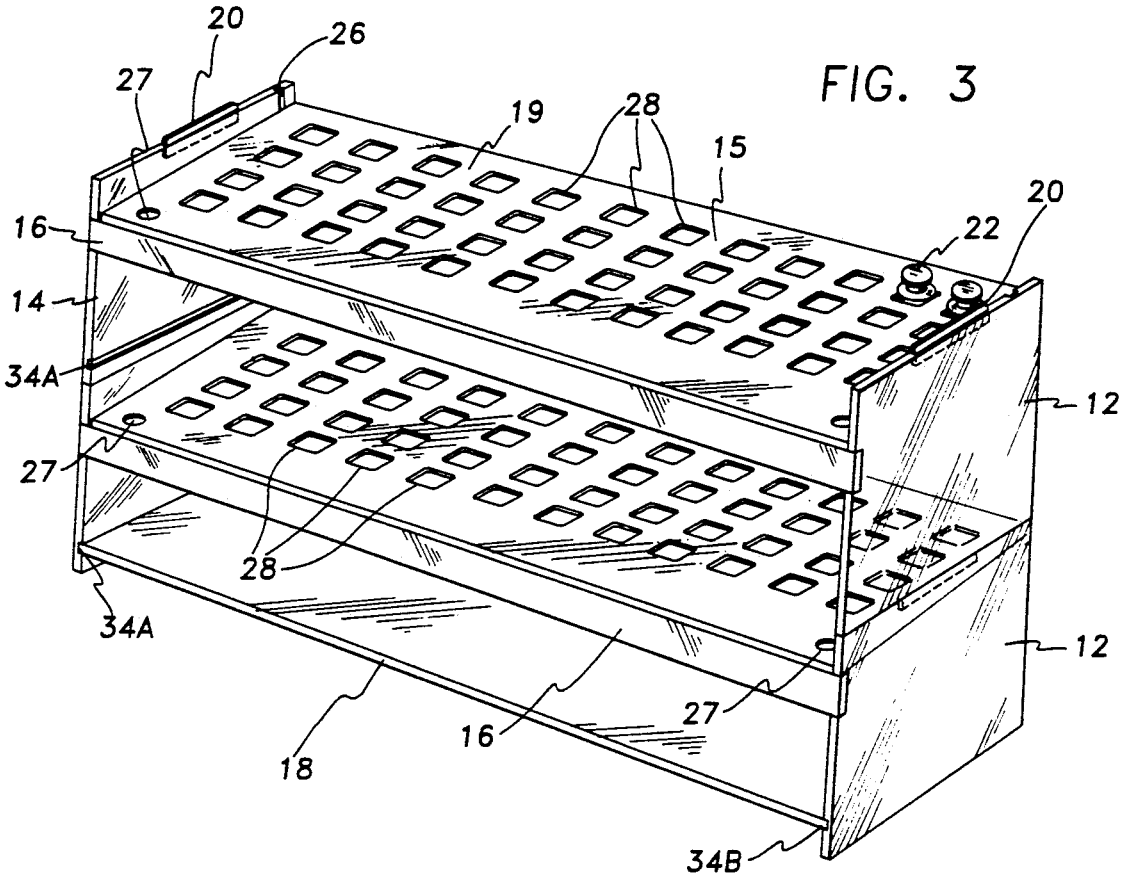
FIG. 3
FIG. 4
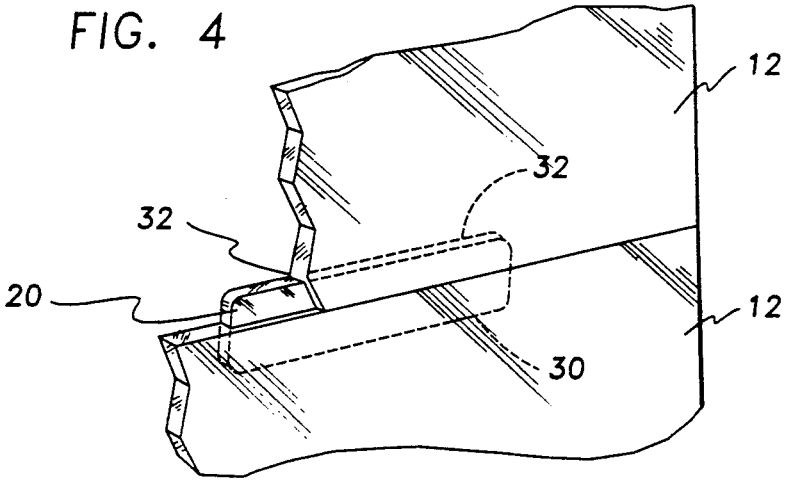

TUBE DISPLAY DEVICE

FIELD OF THE INVENTION

The present invention relates to display devices, and in particular devices for the display of articles having a squeeze tube type configuration.

DESCRIPTION OF THE PRIOR ART

Devices to display articles are known in the art. U.S. Pat. No. 3,604,566 issued to Rem and Smith discloses a test tube holder. Circular apertures are provided for holding test tubes of various sizes and are color coded for biomedical testing purposes. A single test tube is supported by a two level support system.

U.S. Pat. No. 3,774,774 issued to Menkel discloses a display stand for the display of solid circular tube type devices, such as a test tube or a single cigar tube. The structure includes a series of steps, each step for holding a row of tubes so that information concerning its contents can be discerned.

U.S. Pat. No. 3,778,232 issued to McMorrow discloses a display device for the display of test tubes. The device is designed to assist in the typing of blood and blood products. Circular apertures are provided in a multiple layered device where a single tube is supported by more than one level.

U.S. Pat. No. 4,378,889 issued to Lebowitz discloses a spice bottle display rack and bracket assembly. Circular mounts are provided at an angle for holding spice bottles in an easily accessible manner. These mounts form a bottle receiving structure which are then layed out in step type relation in multiple rows.

None of the above referenced devices, considered either singly or in combination, is seen to suggest the instant invention as claimed.

SUMMARY OF THE INVENTION

This invention is a tube display rack designed to hold different tubes of professional hair color or any tube product. Each unit will accomodate tubes of hair color in such a manner as to discern the type and amount of product. The units have the capacity to be stacked atop each other. The tube holding panel is angled so that each row of four tubes may be viewed. This arrangement permits easy access to all twelve columns of tube apertures. The unit functions as an inventory control device, organizer, and storage unit.

Accordingly, one object of the present invention is to provide a squeeze tube display rack which holds tubes in an easily accessible and organized manner.

Another object of the present invention is to provide a squeeze tube display rack which may be stacked in a multiple unit fashion, one atop another.

These and other objects of the present invention will become readily apparent upon further review of the following specification and drawings.

BRIEF DESCRIPTION OF THE DRAWINGS

FIG. 3 shows a perspective view of the preferred embodiment in stacked relation; and FIG. 4 shows a partial cut away view of the right side of the preferred embodiment in stacked relation.

Similar reference characters denote corresponding features consistently throughout the attached drawings.

DETAILED DESCRIPTION OF THE PREFERRED EMBODIMENT

Figure 1:
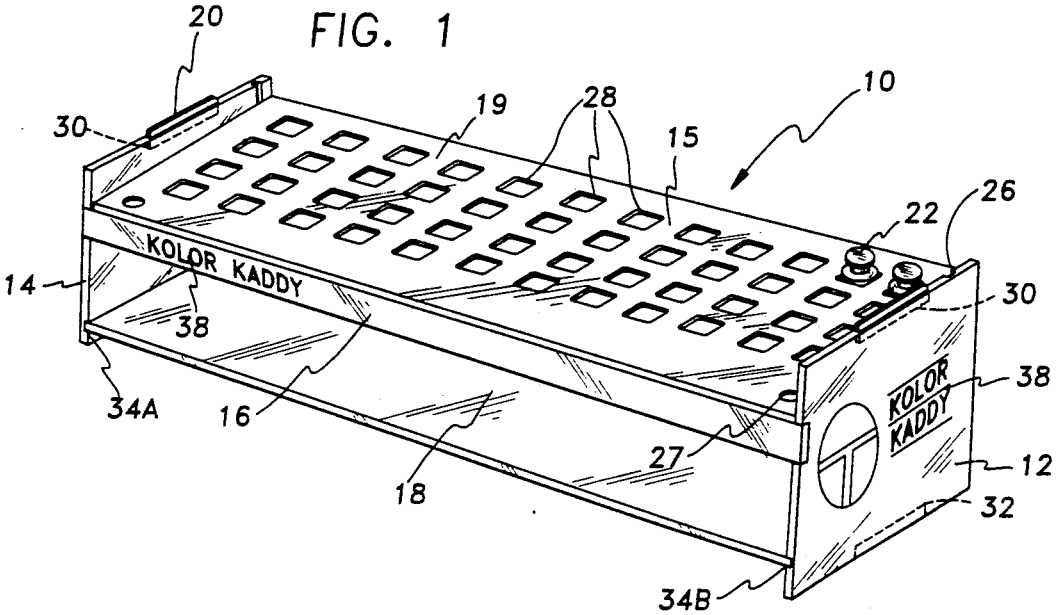
FIG. 1 shows a perspective view of the preferred embodiment.
Figure 2:
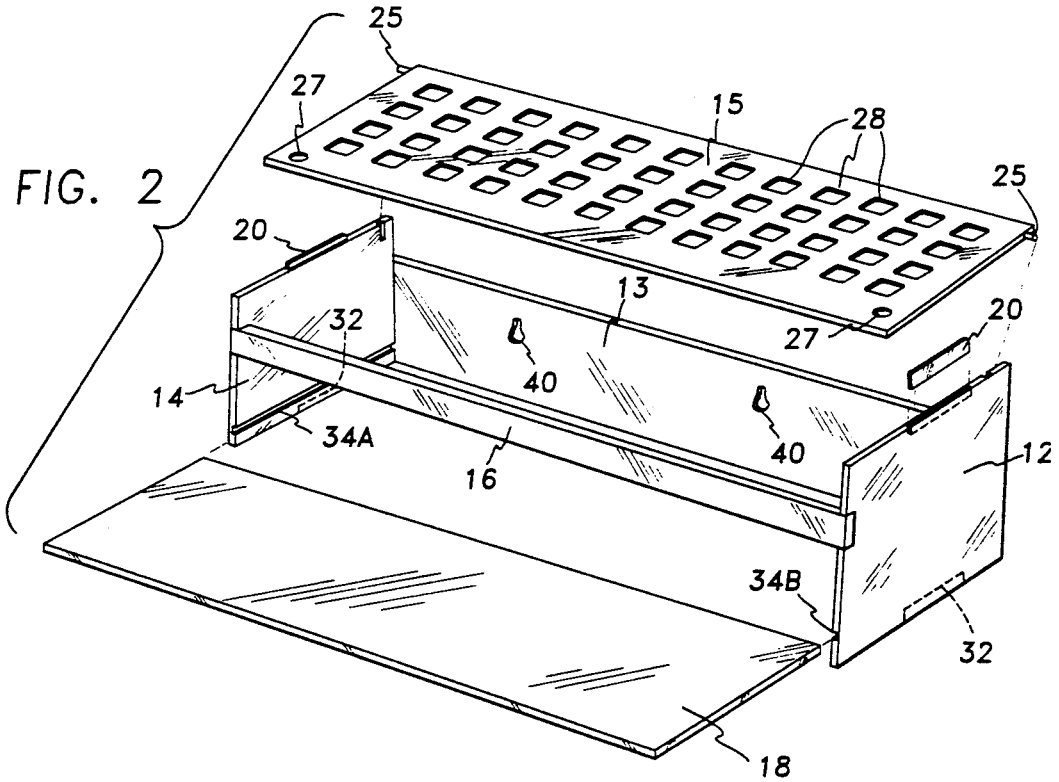
FIG. 2 shows an exploded perspective view of the preferred embodiment.

The present invention comprises a squeeze tube display rack 10. The squeeze tube display rack 10 has a right sidewall 12 and a left sidewall 14 which are parallel and upstanding. A rear upstanding wall 13 is placed between the right sidewall 12 and the left sidewall 14 in a perpendicular fashion and connects the parallel sidewalls 12, 14 in the rear. Two small grooves (34A, 34B) are made in the right sidewall 12 and the left sidewall 14 which are located below the midsection of the right sidewall 12 and left sidewall 14 which will permit a floor panel 18 to be removably inserted therein in the grooves (34A, 34B). This floor panel 18 is inserted in between the right sidewall 12 and left sidewall 14 in a horizontal fashion and is removable. Two small dowl pin insert grooves 26 are positioned on the right sidewall 12 and left sidewall 14 near the top rear of the two sidewalls 12 and 14.

These dowl pin insert grooves 26 are designed to receive the dowl pin members 25 of a top display panel 15. The top display panel 15 has a plurality of tube receiving aperture 28 which are approximately square and are designed to receive tubes of color 22. The dowl pin members 26 rest in the dowl pin insert grooves 26 and the top display panel forward section 17 rests on a partial front wall 16 which is affixed to both the right sidewall 12 and the left sidewall 14 in their forward areas. There is a vertical spatial difference between the placement of the partial front wall 16 piece and the dowl pin insert grooves 26 which causes the top display panel 15 to lie in a sloped relation with the top display panel forward section 17 being lower than the top display panel rear section 19. In this manner one can view all of the tubes 22 placed in the tube receiving aperture 28, as well as and their identifying indicia. A pair of circular apertures 27 are made in the top display panel forward section 17. These circular apertures 27 are designed to hold specific accessories used in professional (salon) hair color applications.

The right sidewall 12 and left sidewall 14 have a flat thin top face and a flat thin bottom face. A upper tab receiving slot 30 is made in the center of the right sidewall 12 and left sidewall 14. A lower tab receiving slot 32 is made in the center of the bottom of both the right sidewall 12 and the left sidewall 14. A tab 20 is provided that can be press fitted into the tab receiving slots (30, 32). In this manner the squeeze tube display rack 10 may be stacked atop each other as shown in FIG. 3. The arrangement of the tab receiving slots (30, 32) and the tab 20 is shown in FIG. 4. The squeeze tube display racks 10 are designed to be stacked on top of each other with the tab 20 of the first tube display rack mating with the lower tab receiving slot 32. When in such a nested relationship, the floor panel 18 of the uppermost squeeze tube display rack 10 is removed which permits access to the tubes 22 which are resting on the top display panel 15 of the lower squeeze tube display rack 10.

Indicia 38 is provided on various surfaces of the squeeze tube display rack 10. Two keyhole slots 40 are provided on rear wall 13. This permits the tube display rack 10 to be suspended from a room wall or partition on pegs (not shown).

It is to be understood that the present invention is not limited to the sole embodiment described above, but encompasses any and all embodiments within the scope of the following claims.

We claim:

1. A squeeze tube display rack comprising a rear upstanding wall, first and second side upstanding walls rigidly connected to said rear upstanding wall, a partial front wall, said partial front wall rigidly connecting said first and second side upstanding walls, said partial front wall having a top surface terminating below a top surface of said rear upstanding wall, and a removable top panel having right and left sides, said removable top panel also having pivot means disposed upon said right and left sides, said pivot means respectively engaging said first and second side upstanding walls, said removable top panel being supported at an inclination by said pivot means and the top surface of the partial front wall, said first and second side upstanding walls being parallel and having respective opposing parallel faces, said opposing parallel faces each having disposed thereon a groove, which groove may support a horizontally disposed floor panel, said removable top panel further having a plurality of apertures extending therethrough whereby a plurality of tubes can be placed in resting relation in the apertures, permitting ease of storage and use.

2. A squeeze tube display rack as claimed in claim 1 where said first and second side upstanding walls have a top face and a bottom face, each said top face has a tab nested in a first tab receiving slot located centrally on each said top face.

3. A squeeze tube display rack as claimed in claim 2 where said each said bottom face said bottom face has a second tab receiving slot located centrally on said bottom face, said first tab receiving slot and said second tab receiving slot being parallel.

4. A squeeze tube display rack as claimed in claim 1 where said plurality of apertures are of a rectangular configuration.

5. A squeeze tube display rack as claimed in claim 4 further comprising several circular apertures located on said removable top panel.

6. A squeeze tube display rack as claimed in claim 1 further comprising a plurality of holes located centrally on said rear upstanding wall whereby said squeeze tube display rack may be suspended from a room wall by a plurality of pegs.

7. A squeeze tube rack as claimed in claim 1 further comprising indicia located on said partial front wall.

8. A squeeze tube rack as claimed in claim 1 further comprising indicia located on said first side wall.

9. A squeeze tube rack as claimed in claim 1 further comprising indicia located on said second side wall.

* * * * *